US012729887B2

(12) United States Patent
Langaas et al.

(10) Patent No.: US 12,729,887 B2
(45) Date of Patent: Sep. 8, 2026

(54) COLD STORAGE, A METHOD OF OPERATING A COLD STORAGE, AND A COOLING SYSTEM

(71) Applicant: LOWENCO A/S, Vamdrup (DK)

(72) Inventors: Kim Langaas, Vamdrup (DK); Soren Maarsso, Vamdrup (DK); Marius Adrian Bararu, Vamdrup (DK)

(73) Assignee: LOWENCO A/S, Vamdrup (DK)

( * ) Notice: Subject to any disclaimer, the term of this patent is extended or adjusted under 35 U.S.C. 154(b) by 380 days.

(21) Appl. No.: 18/549,381

(22) PCT Filed: Mar. 9, 2022

(86) PCT No.: PCT/EP2022/055995
§ 371 (c)(1),
(2) Date: Sep. 7, 2023

(87) PCT Pub. No.: WO2022/189486
PCT Pub. Date: Sep. 15, 2022

(65) Prior Publication Data

US 2024/0167733 A1 May 23, 2024

(30) Foreign Application Priority Data

Mar. 9, 2021 (EP) ..... 21161463

(51) Int. Cl.
*F25B 47/02* (2006.01)
*F25B 1/10* (2006.01)
*F25B 11/02* (2006.01)

(52) U.S. Cl.
CPC ..... *F25B 11/02* (2013.01); *F25B 1/10* (2013.01); *F25B 47/02* (2013.01)

(58) Field of Classification Search
CPC .... F25B 11/02; F25B 1/10; F25B 7/00; F25B 47/02; F25B 47/022; F25B 47/025;
(Continued)

(56) References Cited

U.S. PATENT DOCUMENTS 2,062,054 A 11/1936 Huggins
5,584,191 A 12/1996 Kwon
2009/0031737 A1* 2/2009 Ueno ..... F25B 13/00 62/470

FOREIGN PATENT DOCUMENTS

JP S5767757 A 4/1982
JP S61134544 A 6/1986
(Continued)

OTHER PUBLICATIONS

English translation of Jimoon (KR-20200074643-A) (Year: 2020).*
(Continued)

*Primary Examiner* — Miguel A Diaz
(74) *Attorney, Agent, or Firm* — Workman Nydegger

(57) ABSTRACT

A cold storage includes a compartment, a first evaporator chamber in fluid communication with the compartment, a second evaporator chamber in fluid communication with the compartment, a first cooling system and a second cooling system, each cooling system comprising a compressor unit, a condenser structure, a first evaporator, a second evaporator, and a controller configured to control flow of refrigerant from the condenser structure to one or both of the first and second evaporators. To allow full operation with one of the two cooling systems and thereby preserve the other cooling system as a spare system, the first evaporators are arranged in the first evaporator chamber, and the second evaporators are arranged in the second evaporator chamber, allowing both chambers to be operated with each of the two cooling systems.

25 Claims, 8 Drawing Sheets

(58) Field of Classification Search
CPC ..... F25B 2347/00–023; F25B 25/005; F25B 2313/009; F25B 2400/06; F25B 5/02
See application file for complete search history.

(56) References Cited

FOREIGN PATENT DOCUMENTS

| | | | | | |
|---|---|---|---|---|---|
| KR | 102024241 | B1 | | 9/2019 | |
| KR | 20200074643 | A | * | 6/2020 | ..... F25B 49/02 |
| WO | 02066908 | A1 | | 8/2002 | |
| WO | 2006067735 | A1 | | 6/2006 | |
| ZA | 200006853 | B | | 2/2002 | |

OTHER PUBLICATIONS

Mosaffa et al., "Exergoeconomic and environmental analyses of CO2/NH3 cascade refrigeration systems equipped with different types of flash tank intercoolers", Energy Conversion And Management, Mar. 23, 2016, pp. 442-453, vol. 117, Elsevier Science Publishers.
Extended European Search Report from corresponding European Patent Application No. EP21161463.1, Aug. 12, 2021.
International Search Report from corresponding PCT Application No. PCT/EP2022/055995, Jun. 10, 2022.

* cited by examiner

COLD STORAGE, A METHOD OF OPERATING A COLD STORAGE, AND A COOLING SYSTEM

INTRODUCTION

The disclosure relates to a cold storage and a method of operating a cold storage comprising a compartment which is cooled. Particularly, the disclosure relates to a method of operating a cold storage for ultralow-temperature. The disclosure further relates to a cooling system.

BACKGROUND

Traditionally, cold storages for ultralow-temperature comprise a compartment with highly insulated walls and include a cooling system for decreasing the temperature in the compartment. Typically, the cooling system is a vapor-compression cooling system with a refrigerant being circulated through a condenser and an evaporator.

It is an object of existing cold storages to obtain a uniform temperature in the compartment. U.S. Pat. No. 5,584,191 discloses a conventional refrigerator with a fan which circulates cold air from an air duct. The duct controls a quantity of the cold air which is flowing into the storage space and the air is introduced into different places of the space. Also, WO2006/067735 discloses a cooling device with a fan blowing cold air around the evaporator to the compartment being cooled.

SUMMARY

It is an object of the disclosure to improve protection of valuable substances being contained in the compartment and particularly to reduce risk of malfunctioning potentially leading to lack of cooling and additionally to increase the cooling efficiency particularly related to the time necessary to solidify a substance stored in the compartment. It is a further object to facilitate economic, efficient, and safe operation, and to ensure lowest freezing time of a substance in the compartment.

For this and other objects, the disclosure provides a cold storage and a method of operating a cold storage, and a cooling system.

In a first aspect, a cold storage is disclosed. The cold storage comprises:

- a compartment,
- a first evaporator chamber in fluid communication with the compartment,
- a second evaporator chamber in fluid communication with the compartment,
- a first cooling system and a second cooling system, each cooling system comprising a compressor unit, a condenser structure, a first evaporator, a second evaporator, and a controller configured to control flow of refrigerant from the condenser structure to one or both of the first and second evaporators to thereby define the evaporators as active when provided with cooling refrigerant or inactive when not provided with cooling refrigerant,
- wherein the first evaporators are arranged in the first evaporator chamber, and the second evaporators are arranged in the second evaporator chamber.

Since each cooling system has an evaporator in two different evaporator chambers, the cold storage may continue in operation with only one cooling system being active, and it may e.g. defrost while being in freezing operation even with only one compressor unit activated.

The cold storage may e.g. be used for freezing medical substances such as vaccine, and the temperature may be reduced e.g. to below minus 70 degrees. The compartment may be formed by a container, particularly a container for intermodal transportation for easy transport of the cold storage.

The first and second evaporator chamber may particularly be different chambers both being individually in fluid communication with the compartment. Each chamber may form a duct between inlets and outlets into and out of the compartment, and the evaporators may be located in the ducts.

The evaporator chambers may particularly be releasable from the compartment, and particularly individually releasable from the compartment to thereby allow swift and easy replacement of one or both chambers in connection with maintenance or repair.

The first and second cooling systems may particularly be made in stages, e.g. in two or three stages for different temperature ranges. The cooling systems may be identical, and they may each have a high temperature stage, a middle temperature stage and a low temperature stage.

In such a system, the low temperature stage may provide cooling refrigerant to one or both evaporators of that system and thereby make those evaporators active.

The middle stage or the low temperature stage may also provide heating refrigerant to one or both evaporators of that system and thereby make those evaporators defrosting.

The cooling refrigerant may e.g. be provided from the condenser structure, i.e. after condensation of the refrigerant, at it may be provided via one or more expansion valves. By expansion of the refrigerant, the refrigerant becomes cooling refrigerant.

The cooling refrigerant may contain at least a fraction which is provided from the condenser structure after condensation. In one embodiment, the cooling refrigerant is exclusively from the condenser structure, and in another embodiment, a part of the cooling refrigerant is not condensed by the condenser structure and another part of the cooling refrigerant is condensed by the condenser structure.

The heating refrigerant may e.g. be provided from an outlet of the compressor before condensation. To avoid thermal stress, the refrigerant could be cooled to a certain temperature below the compression outlet temperature of the compressor.

The heating refrigerant may contain at least a fraction which is provided from an outlet of the compressor before condensation. In one embodiment, the heating refrigerant is exclusively not condensed by the condenser structure and in another embodiment, a part of the heating refrigerant is not condensed by the condenser structure and another part of the hearting refrigerant is condensed by the condenser structure.

The heating refrigerant may differentiate from the cooling refrigerant by the share between the part being condensed and the part not being condensed. The heating refrigerant may have a larger share not being condensed than the cooling refrigerant.

The three stages could operate with the same refrigerant, but typically, individual refrigerants would be selected for each stage depending on the implementation and the desired temperature ranges in each stage, additionally the low temperature and medium temperature stages may use the same refrigerant, while the high temperature stage may use a different refrigerant.

The controller is configured to control flow of cooling refrigerant to one of the first and the second evaporator to thereby define the evaporators as active, and likewise to control flow of heating refrigerant to one of the first and the second evaporator to thereby define the evaporators as defrosting. For this purpose, the controller may be arranged to control valves and thereby direct the cooling or heating refrigerant to one or the other of the two evaporators.

Accordingly, the cold storage may be fully functional with only one of the two cooling systems being activated. The activated cooling system may provide one active evaporator in one of the evaporator chambers and simultaneously one defrosting evaporator in the other evaporator chamber. When defrosting is ended, the controller redirects the flow of refrigerant such that the active evaporator becomes defrosting and the defrosting evaporator becomes active. In that way, continued operation is ensured by use of only one of the two cooling systems. Should one of the two cooling systems fail, the other one can be used as a spare system, and again ensure continuous operation with alternating shift between the two evaporators as either being active or defrosting.

Accordingly, the controller may be configured to shift between:

- a normal mode of operation wherein the first evaporator of a primary one of the first and second cooling systems is active, and the other evaporators are not active, and
- a defrosting mode of operation wherein the second evaporator of the primary cooling system is active, and the first evaporator of the primary cooling system is inactive or defrosting.

Particularly, the controller may be configured to alternate between the normal mode and the defrosting mode, vice versa.

Additionally, the controller may be configured, in the normal mode, to operate the second evaporator of the primary cooling system as defrosting, and particularly to operate it as defrosting simultaneously with the operation of the first evaporator as active.

The controller may also be configured to shift to a first cooling mode of operation with a higher cooling capacity. In the first cooling mode, the first evaporator and the second evaporator of at least one of the first and second cooling systems are active simultaneously. In one example, both the first and second evaporators of the first cooling system is active while the other cooling system is not activated. In this way, both evaporator chambers can be used simultaneously with only one activated cooling system and the other cooling system can be saved as a spare system in case of malfunction.

The controller may be configured to shift to a second cooling mode of operation with a higher cooling capacity. In the second cooling mode, the first evaporators or the second evaporators of both the first and second cooling systems are active.

The controller may be configured to shift to a third cooling mode of operation with an even higher cooling capacity. In the third cooling mode, the first and second evaporators of both the first and second cooling systems are active.

If the system comprises a high temperature stage providing high temperature refrigerant, a medium temperature stage providing medium temperature refrigerant, and a low temperature stage providing low temperature refrigerant, the controller may be configured to control the flow of medium temperature refrigerant to one of the first and second evaporators such that a subcritical operation is maintained while defrosting. Particularly, the low and medium temperature stage may be operated strictly in the subcritical field meaning that it will not deviate from subcritical operation.

A first fan system may be arranged for creating an airflow in the first evaporator chamber and a second fan system arranged for creating an airflow in the second evaporator chamber, and wherein the controller is configured to activate selected fan systems to create flow in evaporator chambers with an active evaporator.

The controller may be configured to deactivate selected fan systems for preventing a flow in evaporator chambers with an evaporator which is not active. The controller may e.g. be configured to deactivate selected fan systems for preventing an airflow in evaporator chambers with a defrosting evaporator.

The first evaporator of the first cooling system may be arranged serially with the first evaporator of the second cooling system with respect to an airflow direction in the first evaporator chamber. Likewise, the second evaporator of the first cooling system may be arranged serially with the second evaporator of the second cooling system with respect to an airflow direction in the second evaporator chamber. Serially with respect to an airflow means that one is upstream the other in an airflow between an inlet and an outlet of the evaporator chamber. In one embodiment, the two serial evaporators in one evaporator chamber are made as one single unit.

The first evaporator of the first cooling system may, alternatively, be arranged in parallel with the first evaporator of the second cooling system with respect to an airflow direction in the first evaporator chamber. Likewise, the second evaporator of the first cooling system may be arranged in parallel with the second evaporator of the second cooling system with respect to an airflow direction in the second evaporator chamber. "in parallel" with respect to an airflow means that they are not located upstream/downstream each other in the airflow between the inlet and the outlet of the evaporator chamber. In one embodiment, the two parallel evaporators in one evaporator chamber are made as one single unit.

A cumulative increase of cooling capacity can be determined based on the first time intervals and the air temperature. Finally, the cumulative increase may form the basis for a defrost schedule. This may particularly include defining a threshold value, and comparing the cumulative increase of cooling capacity with the threshold. When the cumulative increase of cooling capacity exceeds a certain percentage of the threshold, it triggers defrosting of the first evaporator. The cumulative increase could be found by the equation:

$$Dfr_{trigger}(i) = \sum_{i=1}^{n} \frac{Q(i) - Q(i-1)}{Qt} + Dfr_{trigger}(i-1)$$

Where Dfr_trigger(i) is the defrost trigger value at the end of a current one of the first time intervals, i.e. ON time interval.

Q(i) is the current interval air cooling capacity, calculated based on air temperature difference across the evaporator as average value for the ON interval;

Q(i−1) is the previous interval air cooling capacity calculated based on air temperature difference across the evaporator Q(t) is the baseline air cooling capacity of the ice free evaporator.

FIGS. 9-11, illustrate the cooling capacity average, the on time, and the cumulative increase in cooling capacity.

As mentioned, the same may apply equally to the second evaporator whereby the method comprises monitoring over time when the second cooling unit is used, i.e. when it actively contributes to the cooling. Based on this monitoring, a set of second time intervals are determined such that the second time intervals are intervals in which the second cooling unit is used. A second cumulative increase of cooling capacity can be determined based on the second time intervals and the air temperature across the second evaporator, and when the second cumulative increase exceeds a certain percentage of the threshold, it is time to defrost the second evaporator.

The controller may be implemented in one or more CPUs with memory and computer executable code for enabling various functions according to the method of the first aspect.

The CPUs could form part of a dedicated computer or a standard computer system, e.g. a PC. The controller may comprise a data interface for communication of data externally, e.g. for exporting results and for importing settings related to the temperature.

Those skilled in the art will appreciate that the functions of the cold storage may be implemented using standard hardware circuits, using software programs and data in conjunction with a suitably programmed digital microprocessor or general-purpose computer, and/or using application specific integrated circuitry, and/or using one or more digital signal processors. Software program instructions and data may be stored on a non-transitory, computer-readable storage medium, and when the instructions are executed by a computer or other suitable processor control, the computer or processor performs the functions associated with those instructions.

In a second aspect, a method is provided for operating said cold storage.

The method comprises:

selecting one of the first and second cooling systems to be a primary cooling system and the other to be a secondary cooling system, providing a flow of cooling refrigerant to one of the first and second evaporators of the primary cooling systems, and providing a flow of heating refrigerant to the other one of the first and second evaporators of the primary cooling system.

The method may comprise a step of redirecting the flow of refrigerant to provide a flow of cooling refrigerant to both the first and second evaporators of the primary cooling systems.

The method may further comprise a step of providing a flow of cooling refrigerant to at least one of the first and second evaporators of the secondary cooling systems.

The method may further comprise a step of switching the primary cooling system to become the secondary cooling system and the secondary cooling system to become the primary cooling system.

The method may comprise operating the cold storage in subcritical phase, and particularly strictly in subcritical phase.

In a third aspect, the disclosure provides a cooling system comprising a compressor unit, a condenser structure, a first evaporator, and a controller configured to control flow of refrigerant from the condenser structure to the first evaporator to thereby define the evaporator as active when provided with cooling refrigerant or inactive when not provided with cooling refrigerant.

The cooling system comprises a high temperature stage, a middle temperature stage and a low temperature stage, two of the three stages being separated by a vessel configured to function as:

a condenser and receiver for the low temperature stage an evaporator for middle temperature stage, an expansion tank for the low and middle temperature stage, and as an evaporator when the evaporator is inactive.

Particularly, the vessel could be located between the medium temperature stage and the low temperature stage.

The controller may be configured to control the flow of medium temperature refrigerant to the evaporator such that a subcritical operation is maintained while defrosting. Particularly, the low and medium temperature stage may be operated strictly in the subcritical field meaning that it will not deviate from subcritical operation.

A fan may be arranged for creating an airflow around the evaporator and the controller may be configured to activate the fan to create flow when the evaporator is active.

The cooling system according to the third aspect may include any of the features disclosed relative to the cold storage and method of the first and second aspects of the disclosure.

LIST OF DRAWINGS

FIGS. 1*a*-1*b* illustrate a cold storage;

DETAILED DESCRIPTION

The detailed description and specific examples are given by way of illustration only since various changes and modifications within the spirit and scope will become apparent to those skilled in the art from this detailed description.

Figure 1A:
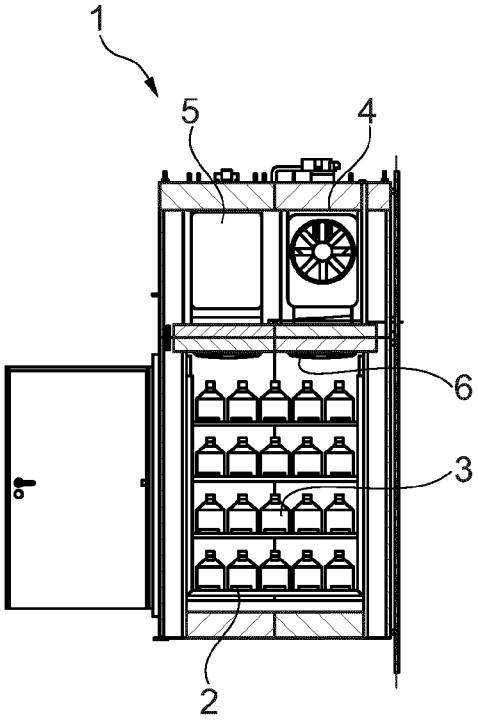
Figure 1B:
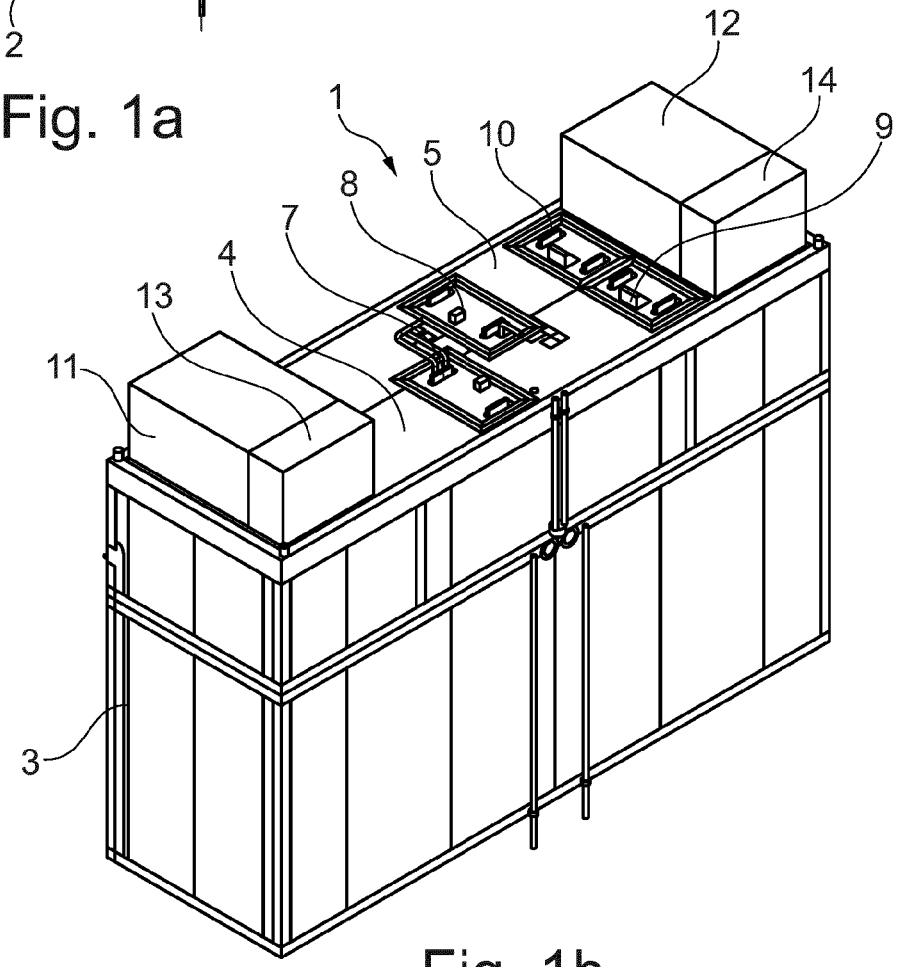

FIGS. 1*a* and 1*b* illustrate a cold storage 1 comprising a compartment 2. The compartment forms a space with thermally insulated walls. It may be formed e.g. by a container, particularly a container for intermodal transport. The illustrated cold storage is made for ultra-low temperatures, particularly below minus 70° C. or even below minus 110° C., and serves to freeze medical substances 3, e.g. vaccine.

The cold storage comprises a first evaporator chamber 4 in fluid communication with the compartment and a second evaporator chamber 5 in fluid communication with the compartment.

The cold storage comprises a first cooling system and a second cooling system. Both cooling systems comprise a compressor unit 11, 12. The compressor units are illustrated schematically as a box and they include one or more compressors connected in different ways known per se, inter alia in cascade/and/or staged/and/or in parallel etc. Particularly, each cooling system may comprise three compressors or three compressor units arranged for three temperature stages, a high temperature stage, a medium temperature stage, and a low temperature stage.

The schematically illustrated boxes 11, 12 also contain a condenser structure with one or more condensers for condensing the refrigerant from the compressors.

Both cooling systems further comprise an evaporator setup comprising inter alia a first evaporator setup 7 connected to the first cooling system and to the second cooling system and a second evaporator setup 8 is connected to the first cooling system and to the second cooling system. Each evaporator setup comprises two separate evaporators, one connected to each of the two cooling systems.

The cold storage further comprises a controller 13, 14 for each of the first and second cooling systems. The controllers are identical, and each controller is configured to control flow of refrigerant from the condenser structure to one or both of the first and second evaporators to thereby define the evaporators as active when provided with cooling refrigerant or inactive when not provided with cooling refrigerant. The controllers may control the compressor unit, the flow of the refrigerant through the evaporators, and/or they may control the fans described later. The flow of refrigerant through the evaporators could be controlled e.g. by controlling one or more expansion valves.

Each cooling system can therefore be operated independent on the other cooling system and thereby provides redundant operation and ensures cooling even if one system is not in operation.

The evaporator chambers 4 and 5 are formed as separate ducts extending between inlets into the compartment and outlets from the compartment. The inlet and outlet are formed in the ceiling 6 inside the compartment.

The first evaporator is arranged in the first evaporator chamber and the second evaporator is arranged in the second evaporator chamber.

The evaporator chambers are located side by side vertically above the ceiling of the compartment 2.

A first fan 9 is located in the duct formed by the first evaporator chamber 4, and a second fan 10 is located in the duct formed by the second evaporator chamber 5.

Figure 2:
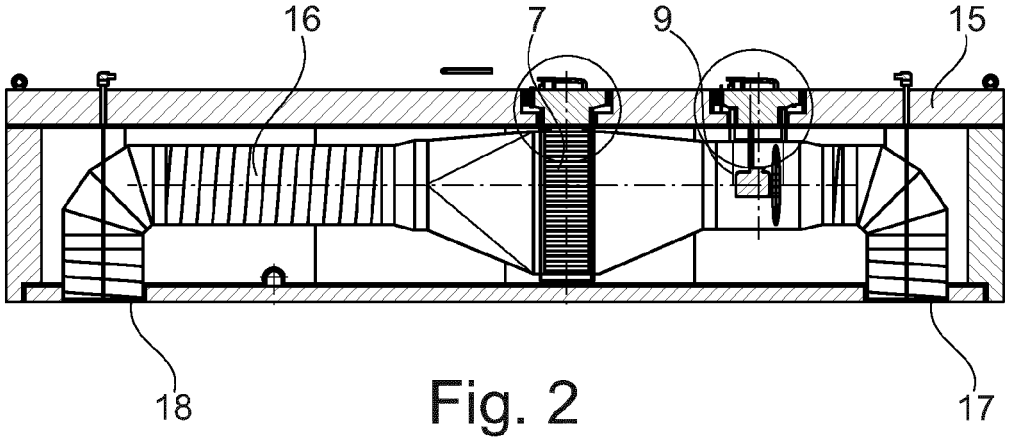
FIGS. 2-4 illustrate evaporator units of the cooling units for the cold storage.

The fans are configured for creating a forced air flow from the inlet 17 to the outlet 18 (c.f. FIG. 2) across the evaporator. The flow of air provides air flow around the substance contained in recipients 3 in the compartment 2. In the illustrated example, the substance is vaccine contained in canisters.

The first cooling system comprises circuit for circulating a first refrigerant between the first compressor unit, the first condenser structure and the first evaporator.

The second cooling system further comprises a second circuit for circulating the second refrigerant between the second compressor unit, the second condenser structure and the second evaporator.

The two cooling units may have separate power supply to ensure independent operation, i.e. if the power supply of one unit fails, the power supply of the second unit may continue and keep the second unit in operation irrespective of a fault in the first unit. Such a safety feature may ensure constant cooling and may be required e.g. for freezing temperature sensitive products such as medicine etc.

Figure 3:
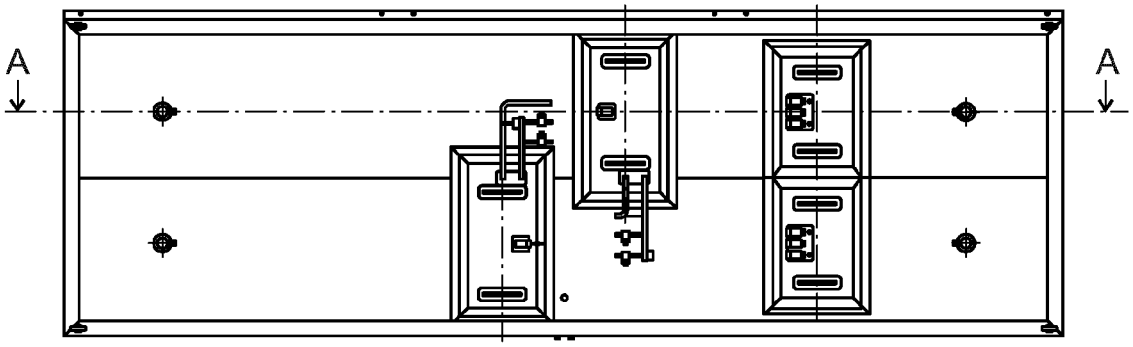
Figure 4:
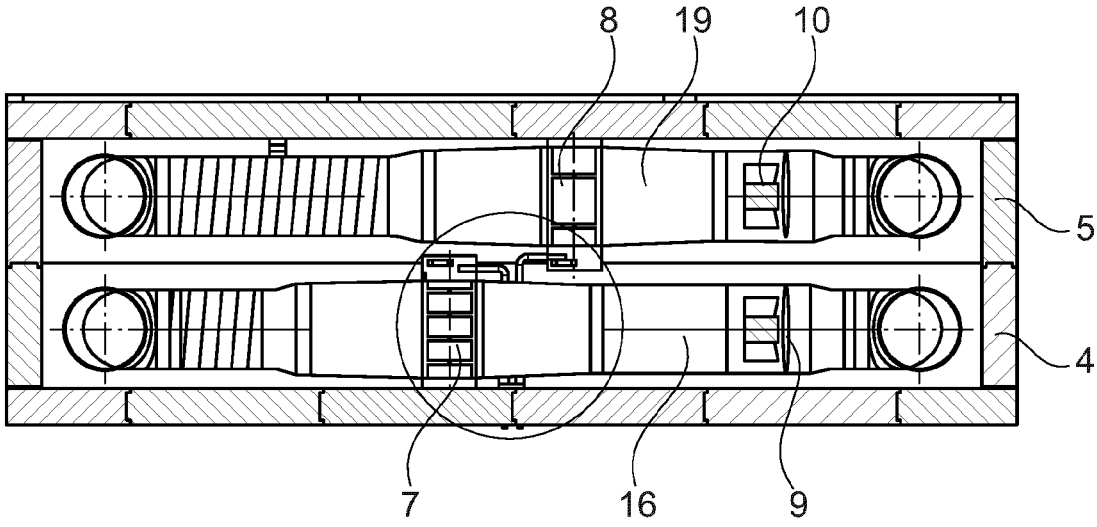

FIG. 2-4 illustrates further details of the evaporator ducts. FIG. 2 illustrates a sideview corresponding to the cross-section along line-AA in FIG. 3. FIG. 4 illustrates top view of the evaporator units. Particularly, FIGS. 2-4 illustrates that the evaporator unit is made as a separate housing 15 which is removably attached to the compartment. The duct 16 forms an inlet 17 from the compartment and an outlet 18 extends into the compartment.

FIG. 4 illustrates the second duct 19 of the second evaporator chamber 5.

Figure 5:
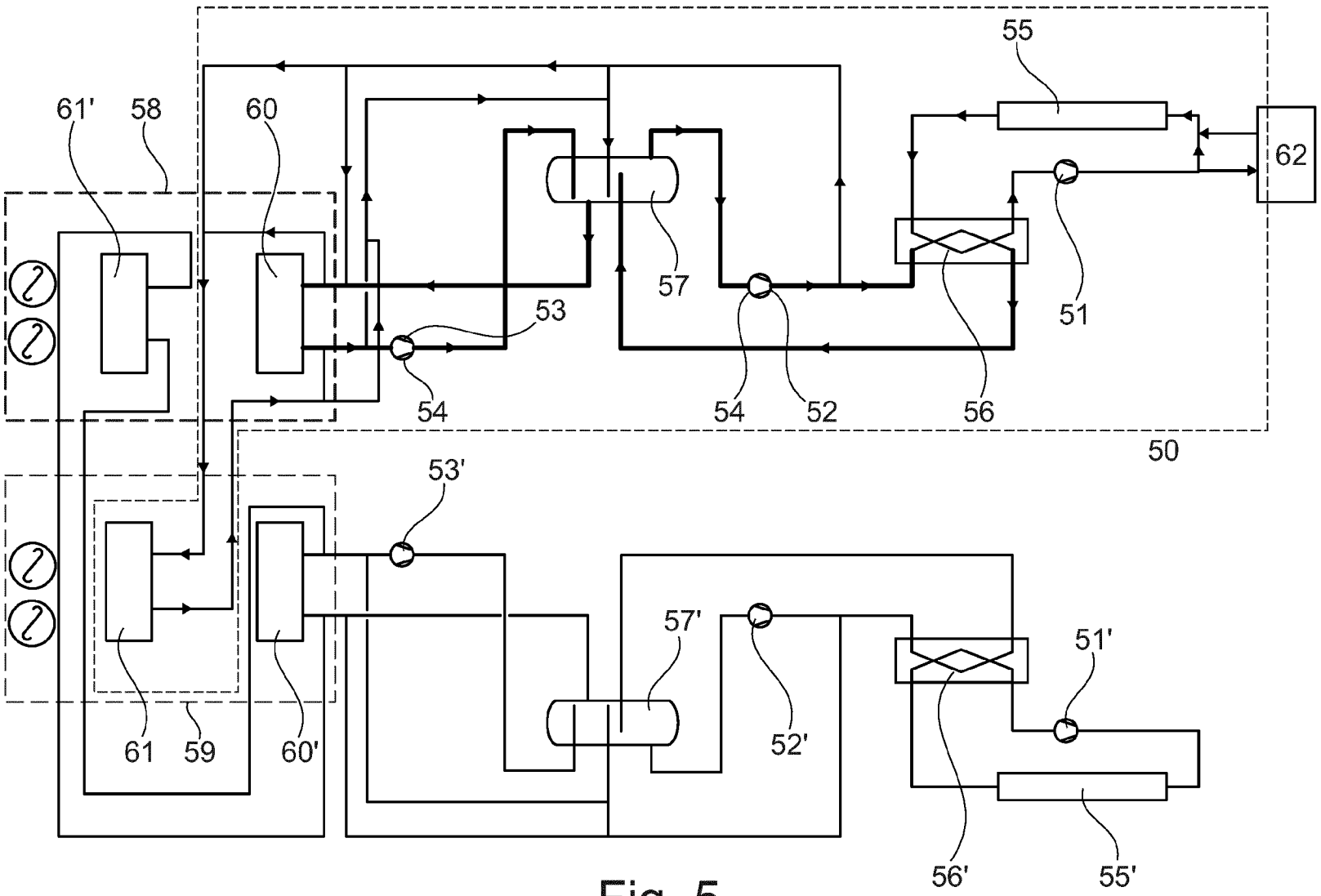
FIG. 5 illustrates in a diagram, the two cooling systems.

FIG. 5 illustrates the first cooling system and the second cooling system in a diagram. The diagram illustrates a first cooling system within the dotted line 50, and a second cooling system outside the dotted line.

Figure 6:
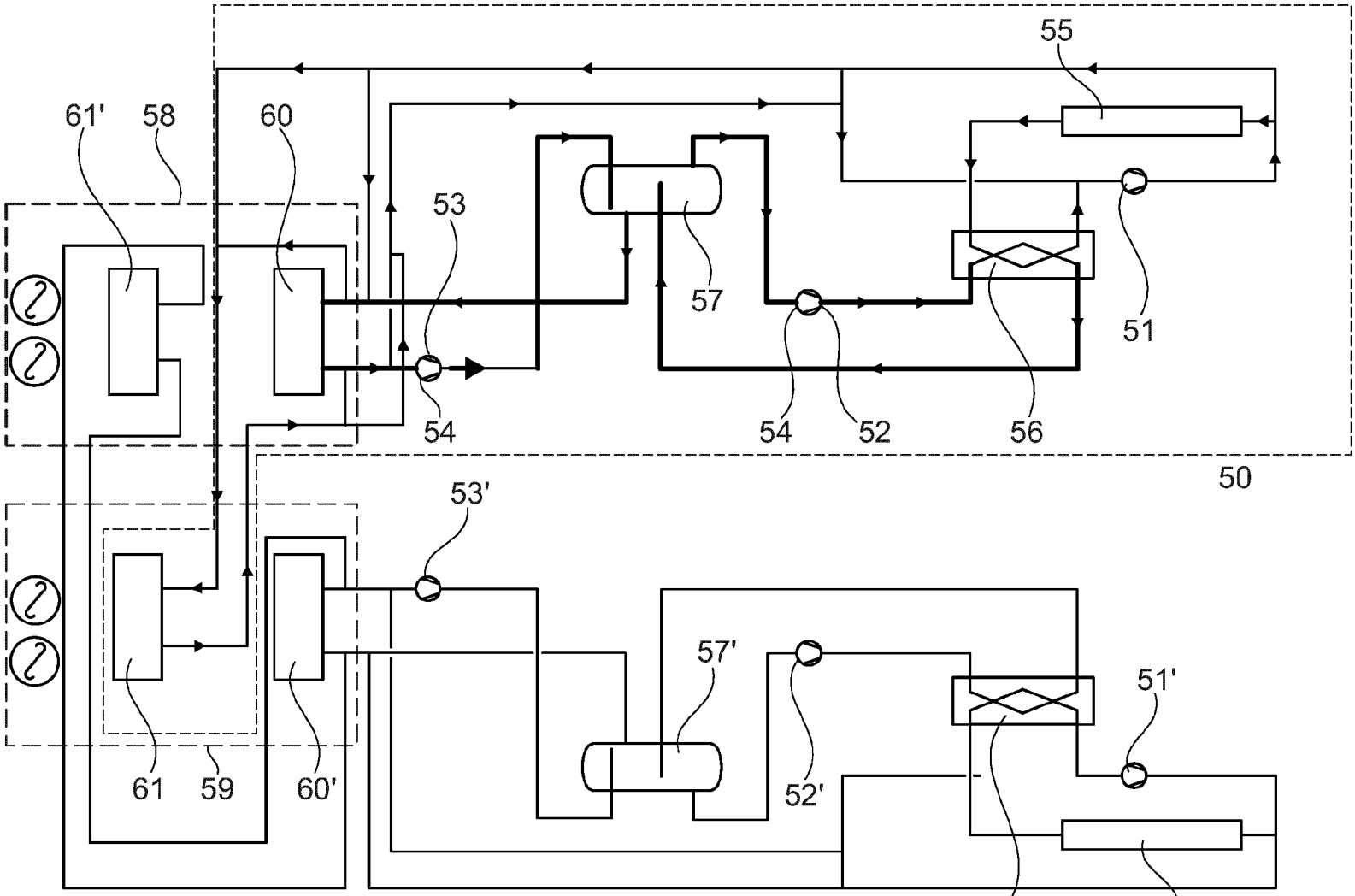
FIG. 6 illustrates in a diagram the two cooling systems in another implementation using a high temperature stage for defrosting.

The cooling systems could have two or more stages. In FIGS. 5 and 6, they are exemplified with three stages, i.e. each cooling system is arranged for three stages being a low temperature stage, a medium temperature stage and a high temperature stage. Each cooling system comprises a compressor unit comprising one or more compressors for each of the three stages, i.e. at least three compressors for each cooling system. The diagram illustrates one compressor 51 for the high temperature stage, one compressor 52 for the medium temperature stage, and one compressor 53 for the low temperature stage.

The medium temperature stage and the low temperature stage compressors are operating on a medium stage and low stage refrigerant and they are therefore referred to herein as the combined stage compressors 54.

In the following, the numbers apply to the first cooling system and the same component in the second cooling system shares the same number with an ' after the number.

The cooling system comprises a condenser structure comprising a high temperature condenser 55. The high temperature condenser is typically an air-cooled/water cooled or glycol cooled condenser.

The cooling system further comprises a heat exchanger 56 functioning as a condenser for the medium temperature stage, and a vessel 57 functioning as 4 components: condenser and receiver for low temperature stage, evaporator for middle temperature stage and expansion tank for low and middle temperature stage. Additionally while in defrost mode it is used as an evaporator.

The receiver function has the purpose of containing extra refrigerant charge when the system is operating at setpoint and to make sure that liquid refrigerant is send to the expansion valve.

The vessel, which forms part of the condenser structure, provides condensation by mixing evaporating refrigerant from the medium stage and the hot refrigerant from the low temperature stage, whereby the hot refrigerant from the low temperature stage condenses.

The cooling system comprises a first evaporator and a second evaporator arranged in two different evaporator chambers illustrated by the dotted lines 58, 59.

Refrigerant can flow from the vessel 57 to one or both of the first 60 and second evaporators 61. The flow is controllable via electrically controlled valves connected to a computerized controller.

The evaporator which receives refrigerant from the vessel will become active, i.e. it is cooled by cooling refrigerant. Evaporators not receiving refrigerant is herein denoted as inactive.

By selective operation of valves, the controller can direct a flow of heating refrigerant to one of the first and the second evaporators to thereby define that evaporator as defrosting. Particularly, the heating refrigerant may be taken from the outlet of the second stage compressor 52. Defrost of evaporator 60 is taking place while evaporator 61 is active (in cooling mode). During that process, the medium stage is operated strictly in subcritical phase.

Additionally, connections 62 of the high temperature refrigerant of the high temperature stage may be used for heating the cold storage door frame. The energy stored in the high temperature refrigerant is usually rejected to ambient, and the cold storage door frame is heated using electrical heating. By using the hot gas of the high temperature stage for heating the cold storage door frame, energy used by electrical door frame heating can be partly or totally saved. Additionally, the condenser load is decreased, savings being possible by using less energy on the condenser fan(s) and or pump(s). Of course, same principle can be applied for the high temperature gas resulted from the middle and low temperature compressor.

Door heating with high temperature refrigerant is used only when the system is operating in certain conditions, conditions that are determined by the controller. Additionally, the temperature of the door frame heating may be controlled by controlling the refrigerant flow. FIG. 6 illustrates hot gas defrost using a high temperature compressor 51 with low pressure refrigerant for defrost. In this configuration, the high temperature refrigerant from the high temperature stage is used for defrosting the evaporators. In this case the evaporators would have two sets of inlets and outlets operating with two different refrigerants: one for cooling and one for heating.

Figure 7:
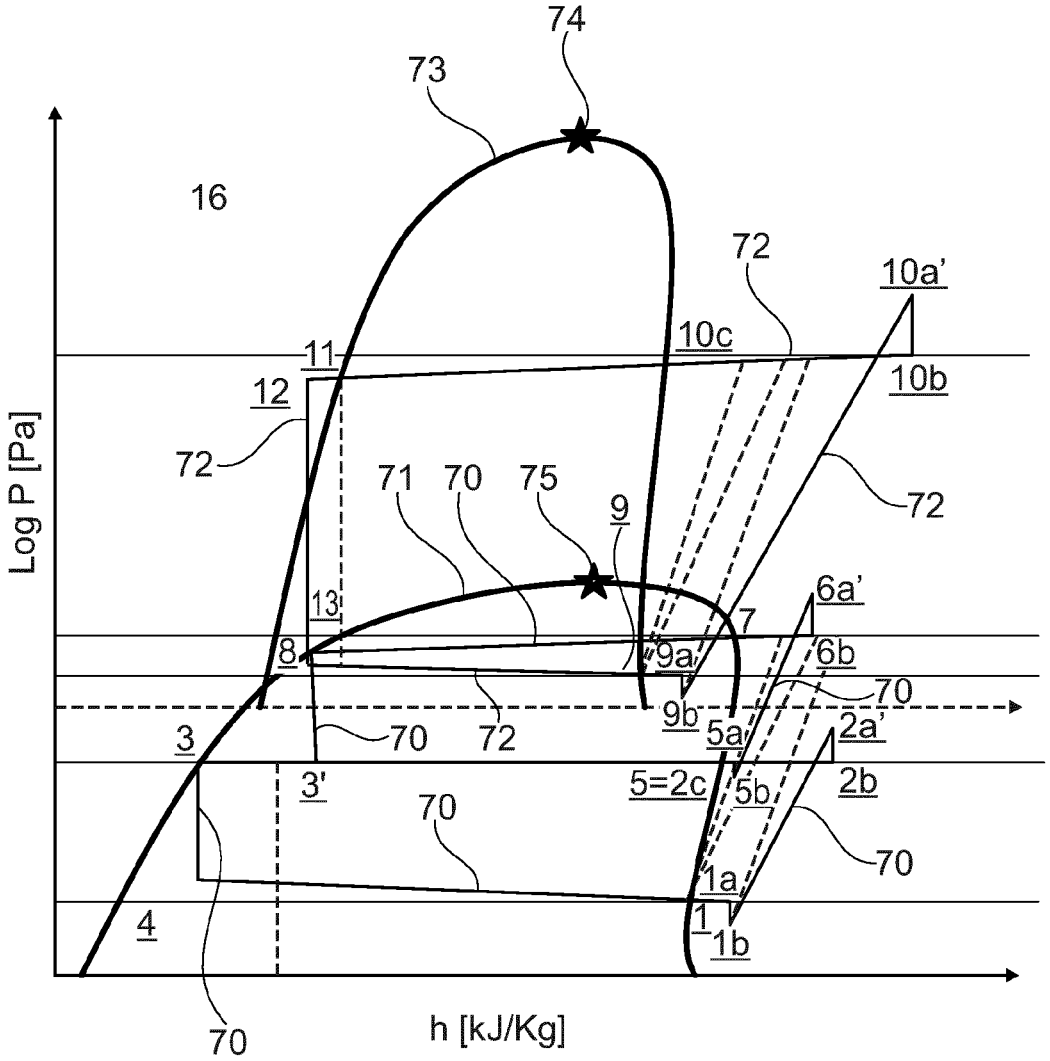
FIG. 7 illustrates a diagram with Log P(Pa) along the abscissa and h(kJ/kg) along the ordinate.

FIG. 7 illustrates the system main processes evaporation, compression, condensation and expansion of refrigerant and state points of the main processes. The diagram is showing two refrigerants used in the system. The low and medium temperature where the processes are shown with curve 70 is using an ultra-low temperature refrigerant.

While in operation, the low temperature and medium temperature are maintained in subcritical region. The saturation curve of the low and medium temperature refrigerant is shown with the curve 71.

The high temperature stage thermodynamic properties and system properties are shown by the curve 72 while the saturation curve of the high temperature refrigerant is shown as curve 73. The critical point for each refrigerant is shown with the stars 74 and 75.

Figure 8:
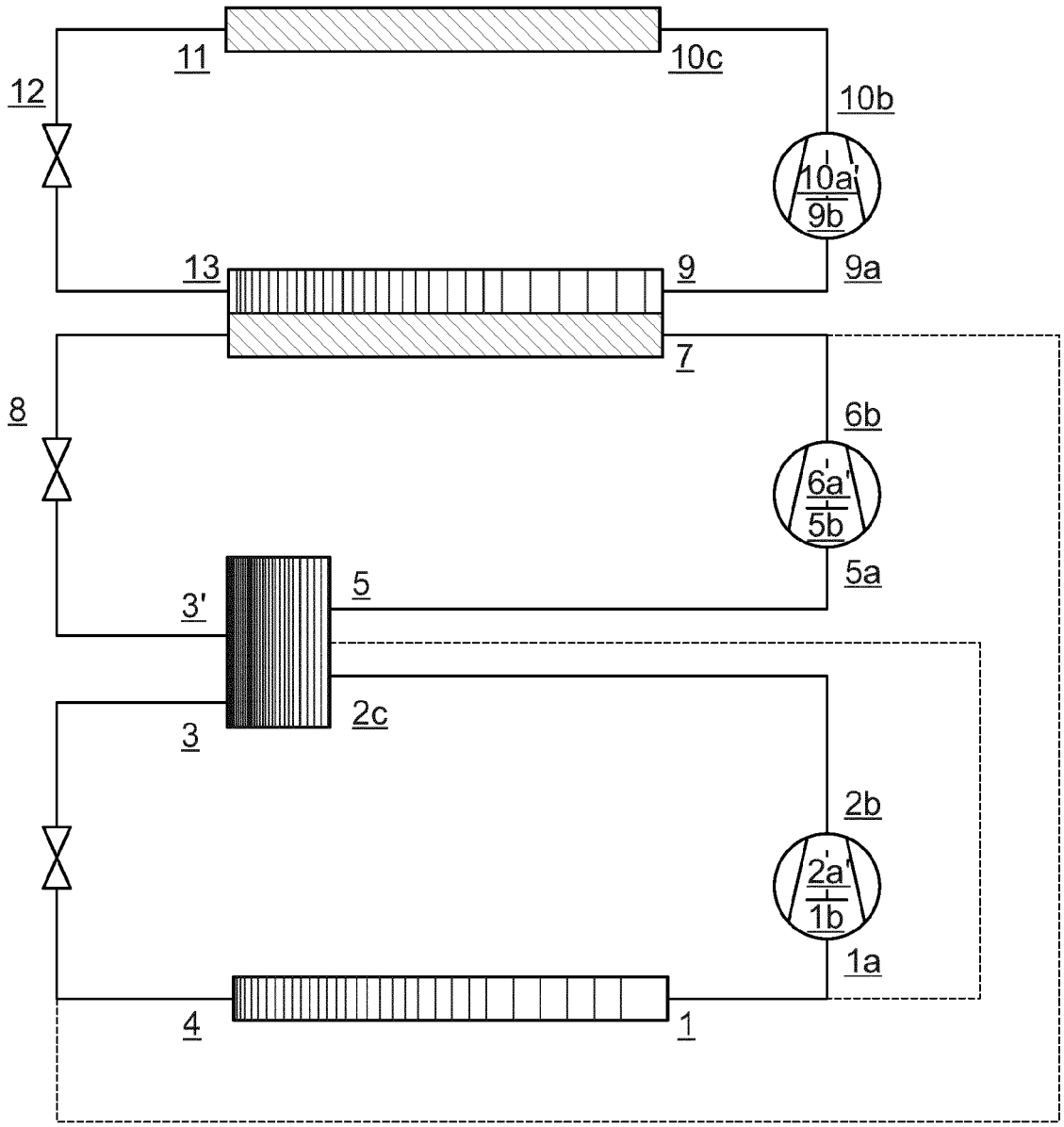
FIG. 8 illustrates a system diagram.

FIG. 8 illustrates a simplified piping and instrumentation diagram including the corresponding state points as shown in FIG. 7.

Figure 9:
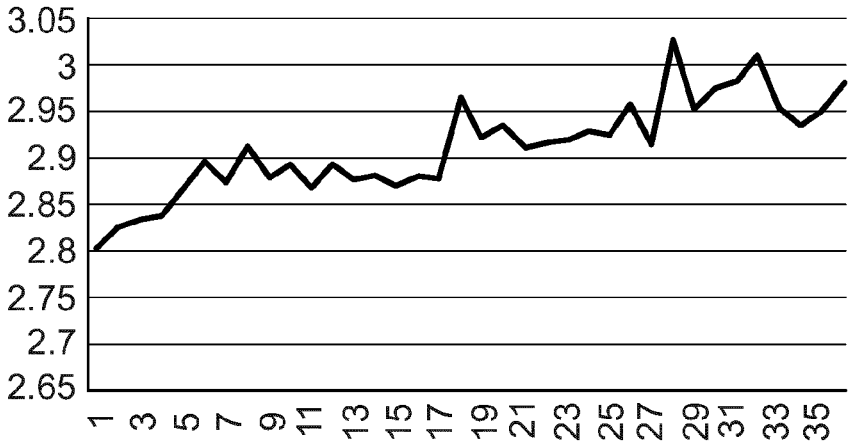
FIGS. 9-11 illustrate cooling capacity, on time, and cumulative cooling capacity.
Figure 10:
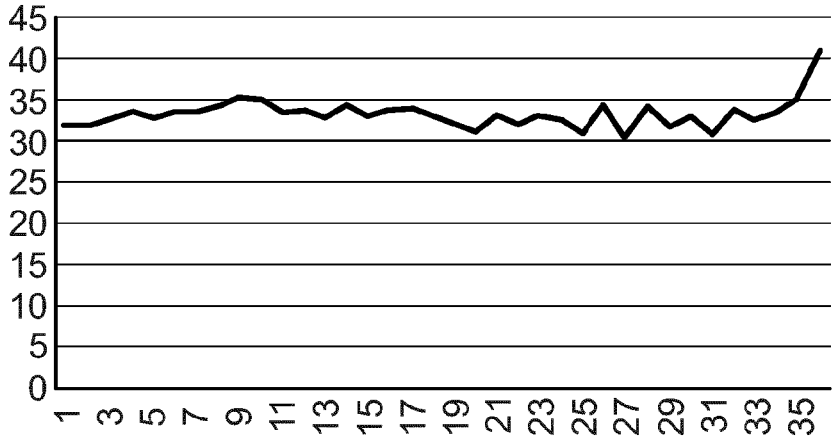
Figure 11:
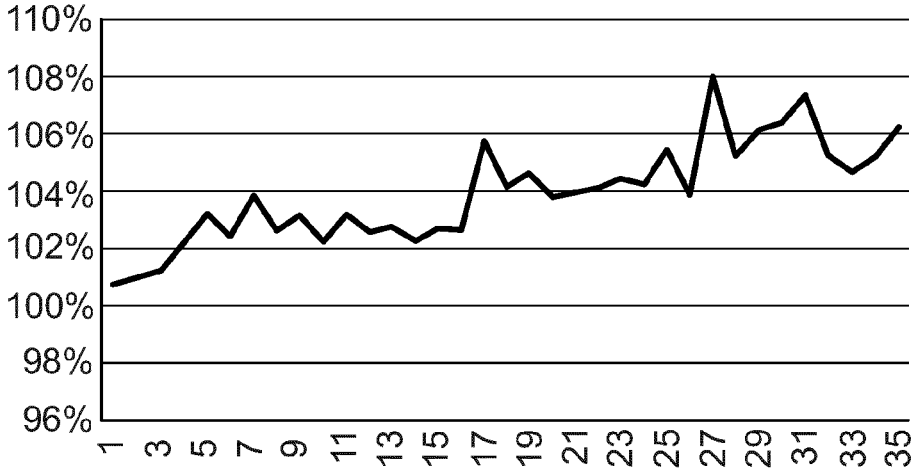

FIGS. 9-11 illustrate monitoring of the first cooling unit. This is taken as an example, and it may just as well be monitoring of the second cooling unit.

FIG. 9 illustrates cooling capacity as a function of average on time intervals, i.e. on the abscissa, it illustrates on time interval number. This is an interval number in said first set of intervals being where the first cooling unit is turned on an contributes to the cooling of the compartment. Along the ordinate it illustrates the evaporator air cooling capacity Q measured in kilowatt.

FIG. 10 illustrates on time duration as a function of on time interval number.

On the abscissa, FIG. 10 illustrates an interval number in said first set of intervals being where the first cooling unit is turned on an contributes to the cooling of the compartment.

Along the ordinate, it illustrates the minutes in which one of the first or second cooling units are used for actively cooling the compartment, referred to herein as on-time. This could e.g. be when the corresponding compressor is turned on, or at least when the controlling valve is open and allows refrigerant to enter the corresponding evaporator. The unit of the ordinate is minutes.

FIG. 11 illustrates the cumulative cooling capacity as a function of the number of the on-time interval.

On the abscissa, FIG. 11 illustrates an interval number in said first set of intervals being where the first cooling unit is turned on an contributes to the cooling of the compartment.

Along the ordinate FIG. 11 illustrates the cumulative cooling capacity Q in percentage. The cumulative cooling capacity is found by the equation:

$$Dfr_{trigger}(i) = \sum_{i=1}^{n} \frac{Q(i) - Q(i-1)}{Qt} + Dfr_{trigger}(i-1)$$

This cumulative cooling capacity is compared with a threshold and based thereon, it is determined when to defrost.

All the above is explained relative to the first cooling unit, and it may apply equally to the second cooling unit.

Figure 12:
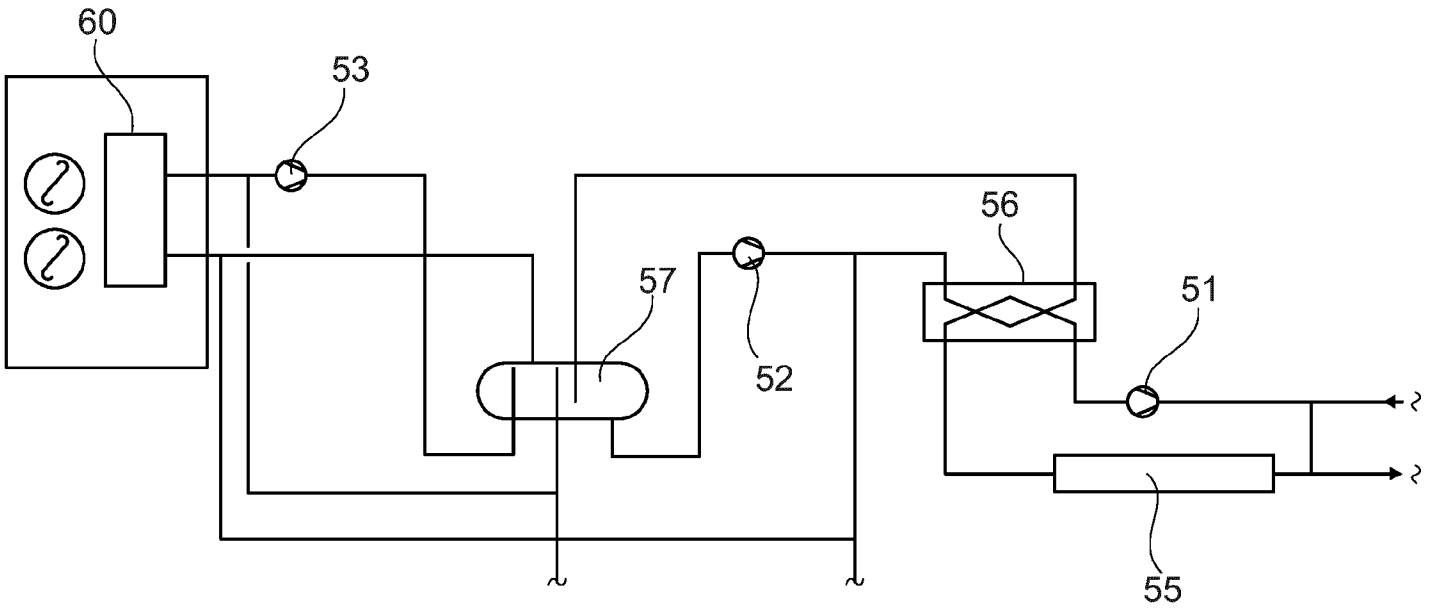
FIG. 12 illustrates a diagram of a cooling system with a vessel having four functions.

FIG. 12 illustrates diagrammatically, a cooling system. The system may comprise the components illustrated in FIG. 1. Particularly, the system comprises a compressor unit, a condenser structure, a first evaporator 60, and a controller which can control the evaporator between an active and an inactive state, where it receives refrigerant depending on the state, e.g. such that it only receives refrigerant in the active state.

The cooling system comprises a high temperature stage, a middle temperature stage and a low temperature stage.

The diagram illustrates one compressor 51 for the high temperature stage, one compressor 52 for the medium temperature stage, and one compressor 53 for the low temperature stage.

The medium temperature stage and the low temperature stage compressors are operating on a medium stage and low stage refrigerant and they could be referred to as "combined stage compressors".

Two of the three stages being separated by a vessel 57 configured to function as:

a condenser and receiver for the low temperature stage an evaporator for middle temperature stage, an expansion tank for the low and middle temperature stage, and as an evaporator when the evaporator is inactive.

The invention claimed is:

1. A cold storage comprising:

a compartment, a first evaporator chamber in fluid communication with the compartment, a second evaporator chamber in fluid communication with the compartment, a first cooling system and a second cooling system, each cooling system comprising a compressor unit, a condenser structure, a first evaporator, a second evaporator, and a controller configured to selectively control a flow of a refrigerant from the condenser structure to either one of the first and second evaporators or to both of the first and second evaporators, wherein the first evaporators is active when provided with a cooling refrigerant or inactive when not provided with the cooling refrigerant, wherein the first evaporators are arranged in the first evaporator chamber, and the second evaporators are arranged in the second evaporator chamber.

2. The cold storage according to claim 1, wherein the controller is configured to control a flow of a heating refrigerant to one of the first and the second evaporators to thereby define the evaporators as defrosting when provided with the heating refrigerant.

3. The cold storage according to claim 2, wherein the heating refrigerant differentiates from the cooling refrigerant by a share between part of the refrigerant being condensed and the part of the refrigerant not being condensed.

4. The cold storage according to claim 2, wherein the heating refrigerant having a larger share not being condensed than the cooling refrigerant.

5. The cold storage according to claim 1, wherein the controller is configured to shift between:

a normal mode of operation wherein the first evaporator of a primary one of the first and second cooling systems is active, and the other evaporators are inactive, and a defrosting mode of operation wherein the second evaporator of the primary cooling system is active, and the first evaporator of the primary cooling system is inactive or defrosting.

6. The cold storage according to claim 1, wherein the controller is configured to shift to a first cooling mode of operation, wherein the first evaporator and the second evaporator of at least one of the first and second cooling systems are active.

7. The cold storage according to claim 6, wherein the controller is configured to shift to a second cooling mode of operation, wherein the first evaporators of both the first and second cooling systems are active.

8. The cold storage according to claim 7, wherein the controller is configured to shift to a third cooling mode of operation, wherein the first and second evaporators of both the first and second cooling systems are active.

9. The cold storage according to claim 1, wherein each cooling system comprises a high temperature stage providing high temperature refrigerant, a medium temperature stage providing medium temperature refrigerant, and a low temperature stage providing low temperature refrigerant.

10. The cold storage according to claim 9, wherein the controller is configured to control the flow of medium temperature refrigerant to one of the first and second evaporators such that a subcritical operation is maintained while defrosting.

11. The cold storage according to claim 1, comprising a first fan system arranged for creating an airflow in the first evaporator chamber and a second fan system arranged for creating an airflow in the second evaporator chamber, and wherein the controller is configured to activate at least one selected fan system of the first and second fan systems to create an airflow in evaporator chambers with an active evaporator.

12. The cold storage according to claim 11, wherein the controller is configured to deactivate at least one selected fan system for preventing an airflow in one or more of the first or second evaporator chambers with one or more of the evaporators which is not active, or which is defrosting.

13. The cold storage according to claim 1, wherein the first evaporator of the first cooling system is arranged serially with the second evaporator of the second cooling system with respect to an airflow direction in the first evaporator chamber, and wherein the second evaporator of the first cooling system is arranged serially with the first evaporator of the second cooling system with respect to an airflow direction in the second evaporator chamber.

14. The cold storage according to claim 1, wherein the first evaporator of the first cooling system is arranged in parallel with the second evaporator of the second cooling system with respect to an airflow direction in the first evaporator chamber, and wherein the second evaporator of the first cooling system is arranged in parallel with the first evaporator of the second cooling system with respect to an airflow direction in the second evaporator chamber.

15. The cold storage according to claim 1, wherein the first evaporator of the first cooling system and the first evaporator of the second cooling system are formed as one single unit in the first evaporator chamber, and wherein the second evaporator of the first cooling system and the second evaporator of the second cooling system are formed as one single unit in the second evaporator chamber.

16. The cold storage according to claim 1, wherein each cooling system comprises a low temperature stage, a medium temperature stage and a high temperature stage.

17. The cold storage according to claim 16, comprising a vessel arranged to function as:

a condenser and receiver for the low temperature stage, an evaporator the medium temperature stage, an expansion tank for the low and the medium temperature stages, and as an evaporator when one of the evaporators is inactive.

18. A method for operating a cold storage according to claim 2, the method comprising:

selecting one of the first and second cooling systems to be a primary cooling system and the other to be a secondary cooling system, providing a flow of the cooling refrigerant to one of the first and second evaporators of the primary cooling system, and providing a flow of the heating refrigerant to the other one of the first and second evaporators of the primary cooling system.

19. The method according to claim 18, comprising redirecting the flow of refrigerant to provide a flow of cooling refrigerant to both the first and second evaporators of the primary cooling system.

20. The method according to claim 18, further comprising providing a flow of the cooling refrigerant to at least one of the first and second evaporators of the secondary cooling system.

21. The method according to claim 18, comprising switching the primary cooling system to become the secondary cooling system and the secondary cooling system to become the primary cooling system.

22. The method according to claim 19, comprising switching between:

a normal mode of operation wherein the first evaporator of a primary one of the first and second cooling systems is active, and the other evaporators are inactive, and a defrosting mode of operation wherein the second evaporator of the primary cooling system is active, and the first evaporator of the primary cooling system is defrosting.

23. The method of claim 22, wherein each cooling system comprises a high temperature stage providing high temperature refrigerant, a medium temperature stage providing medium temperature refrigerant, and a low temperature stage providing low temperature refrigerant, and wherein the medium temperature stage is operated strictly in a subcritical phase in the defrosting mode of operation.

24. The method according to claim 18, comprising determining a cumulative increase of cooling capacity, defining a defrost schedule based on the cumulative increase of cooling capacity, and providing the flow of the heating refrigerant to the evaporators based on the defrost schedule.

25. A cooling system comprising a compressor unit, a condenser structure, a first evaporator, and a controller configured to control a flow of a refrigerant from the condenser structure to the first evaporator to thereby define the first evaporator as active when provided with a cooling refrigerant or inactive when not provided with the cooling refrigerant, wherein the cooling system comprises a high temperature stage, a middle temperature stage and a low temperature stage, two of the three stages being separated by a vessel configured to function as:

a condenser and receiver for the low temperature stage, an evaporator for the middle temperature stage, an expansion tank for the low and the middle temperature stages, and as an evaporator when the first evaporator is inactive.

* * * * *